US005182602A

United States Patent [19]

Kakita et al.

[11] Patent Number: 5,182,602

[45] Date of Patent: Jan. 26, 1993

[54] IMAGE FORMING APPARATUS

[75] Inventors: Akihiko Kakita; Tsugio Sugizaki; Yozo Fujii, all of Hachioji, Japan

[73] Assignee: Konica Corporation, Tokyo, Japan

[21] Appl. No.: 649,055

[22] Filed: Feb. 1, 1991

[30] Foreign Application Priority Data

Feb. 5, 1990 [JP] Japan ..... 2-25824
Feb. 5, 1990 [JP] Japan ..... 2-25825

[51] Int. Cl.[5] ..... G03G 15/14

[52] U.S. Cl. ..... 355/271; 355/274; 355/275; 355/277

[58] Field of Search ..... 355/271, 274, 272, 275, 355/277, 281, 212, 204; 430/126

[56] References Cited

U.S. PATENT DOCUMENTS 4,515,460 5/1985 Knechtel ..... 355/274 X
4,887,101 12/1989 Hirose et al. ..... 346/134
4,905,048 2/1990 Suzuki ..... 355/271
4,983,146 1/1991 Charles et al. ..... 355/212 X
4,984,026 1/1991 Nishise et al. ..... 355/277

FOREIGN PATENT DOCUMENTS 0083777 4/1988 Japan ..... 355/274
0188175 8/1988 Japan ..... 355/274

*Primary Examiner*—A. T. Grimley
*Assistant Examiner*—T. A. Dang
*Attorney, Agent, or Firm*—Finnegan, Henderson, Farabow, Garrett and Dunner

[57] ABSTRACT

The invention provides an image forming apparatus having a transfer device. The transfer device includes a plurality of rollers, a belt and a cam. The belt is rotatable around the plurality of rollers so as to convey a recording sheet thereon. The transfer device is adapted to be pivotable around a pivot axis thereof. The cam pivots the transfer device so as to bring the belt in contact with and out of an imaging surface of a photoreceptor. In the device there is further provided a spring for supporting the transfer device to reduce the weight loaded onto said cam member.

6 Claims, 4 Drawing Sheets

IMAGE FORMING APPARATUS

BACKGROUND OF THE INVENTION

The present invention relates to an image forming apparatus, and more particularly relates to an electrostatic color copier by which a color image of a document can be formed on a recording paper.

In a conventional color image forming apparatus of the kind described above, the following principle is applied: toner is attracted to an electrostatic latent image which has been formed on the circumferential surface of a photoreceptor drum so that a toner image is formed; and the formed toner image is transferred onto a recording paper.

In this kind of image forming apparatus, the following transfer systems by which a toner image on a photoreceptor drum surface is transferred onto a recording paper, have been widely known.

(1) The conveyance transfer system which is characterized in that: an image is transferred onto a horizontally conveyed recording paper while the recording paper is squeezed by a photoreceptor drum and an idle roller. This system is mainly applied to monocolor copiers.

(2) The paper drum transfer system which is characterized in that: a paper drum is provided opposed to a photoreceptor drum; and a recording paper is tightly wound around the paper drum so that an image can be transferred onto the recording paper. This system is mainly applied to color copiers.

The above-described transfer systems have a disadvantage as follows.

(1)' In the case of the conveyance transfer system, an image can be formed on various sizes of paper. However, when the drum size is increased, there is a possibility that a recording paper can become stuck around the photoreceptor drum.

(2)' In the case of the paper drum system, it is suitable for forming a color image since multiple transfer can be conducted. However, this system can not be applied to various sizes of paper, or when thick paper is used as a recording paper.

As large and precise images are required recently, the transfer belt system has become a center of attention, wherein the transfer belt system is characterized in that a recording paper is electrostatically attracted onto the surface of a transfer belt. In the transfer belt system, there is no possibility that a recording paper becomes adhered onto the surface of a photoreceptor drum, so that the transfer belt system is effective when it is applied to a color copier which is provided with a large photoreceptor drum. Consequently, this system has been applied to many copiers.

In the case of a conventional image forming apparatus, the apparatus is composed in such a manner that: a transfer belt unit consisting of a transfer belt stretched around a paper entry side roller (an idle roller) and a delivery side roller (a drive roller) is provided; the transfer belt is pressed against the photoreceptor drum surface with pressure when transfer is conducted; and when transfer is not conducted, the transfer belt is separated from the photoreceptor drum by a cam mechanism provided on a support frame, wherein the transfer belt is rotated around the delivery roller. Then, the transfer belt comes into contact with the photoreceptor drum only when transfer is performed, and the wear of both the transfer belt and photoreceptor drum can be reduced.

Since the transfer belt unit is a heavy structure consisting of at least two rollers, one belt and a frame, a heavy load is given to the cam which moves the transfer unit up and down, so that it is difficult to move the transfer unit in quick response, and further there is a possibility that the cam becomes worn out and problems are caused in the cam drive mechanism.

Due to the above-described situation, it is a primary object of the present invention to provide an image forming apparatus in which the transfer belt can be contacted with and moved from the photoreceptor drum surface without giving too heavy a load to the cam mechanism.

In the case of the above-described conventional image forming apparatus, it is necessary to provide a toner recovery box to the transfer unit, which scrapes the residual toner adhered to the surface of the transfer belt and recovers the scraped toner.

This toner recovery box is fixed to the apparatus body through a delivery tube. On the other hand, the transfer belt unit needs to be attachably provided to the apparatus body so that it can be easily removed from the body when the transfer belt is exchanged during maintenance. Further, the transfer belt unit and the toner recovery box must form one body when copy operations are performed, so that toner can not be scattered from the gap between the transfer belt unit and the toner recovery box.

With a view to solving the problems described above, the second object of the present invention is to provide an image forming apparatus having a means to couple a transfer belt and a toner recovery box is provided, by which the toner recovery box can be easily separated from the transfer belt. Furthermore the means is simply composed and of low cost.

SUMMARY OF THE INVENTION

It is the first object of the present invention to provide an image forming apparatus which is provided with a transfer belt unit comprising a transfer belt stretched around an entry side roller and a delivery side roller and provided with a cam mechanism on a support frame side, said cam mechanism rotated around the delivery side roller so that the transfer belt can be contacted with a photoreceptor drum with pressure when transfer is performed and the transfer belt can be separated from the photoreceptor drum when transfer is not performed; said image forming apparatus characterized in that: a spring means is provided between said belt unit and support frame so that the weight of said transfer belt can be reduced and the load given to the cam can be approximately zero.

It is the second object of the present invention to provide an image forming apparatus which is provided with a transfer belt unit comprising a transfer belt stretched around an entry side roller and a delivery side roller, and provided with a cam mechanism on a support frame side, said cam mechanism rotated around the delivery side roller so that the transfer belt can be contacted with a photoreceptor drum with pressure when transfer is performed and the transfer belt can be separated from the photoreceptor drum when transfer is not performed, said image forming apparatus characterized in that: a toner scraping means to scrape residual toner from the belt is provided to the belt surface at a position close to one of the rollers; a toner recovery box holding means which holds a toner recovery box at an appropriate position to said transfer belt is provided, wherein the transfer belt unit and toner recovery box are coupled by the holding means when copy operations are conducted and can be separated by releasing the holding means when maintenance is conducted.

DETAILED DESCRIPTION OF THE PREFERRED EMBODIMENT

Figure 1:
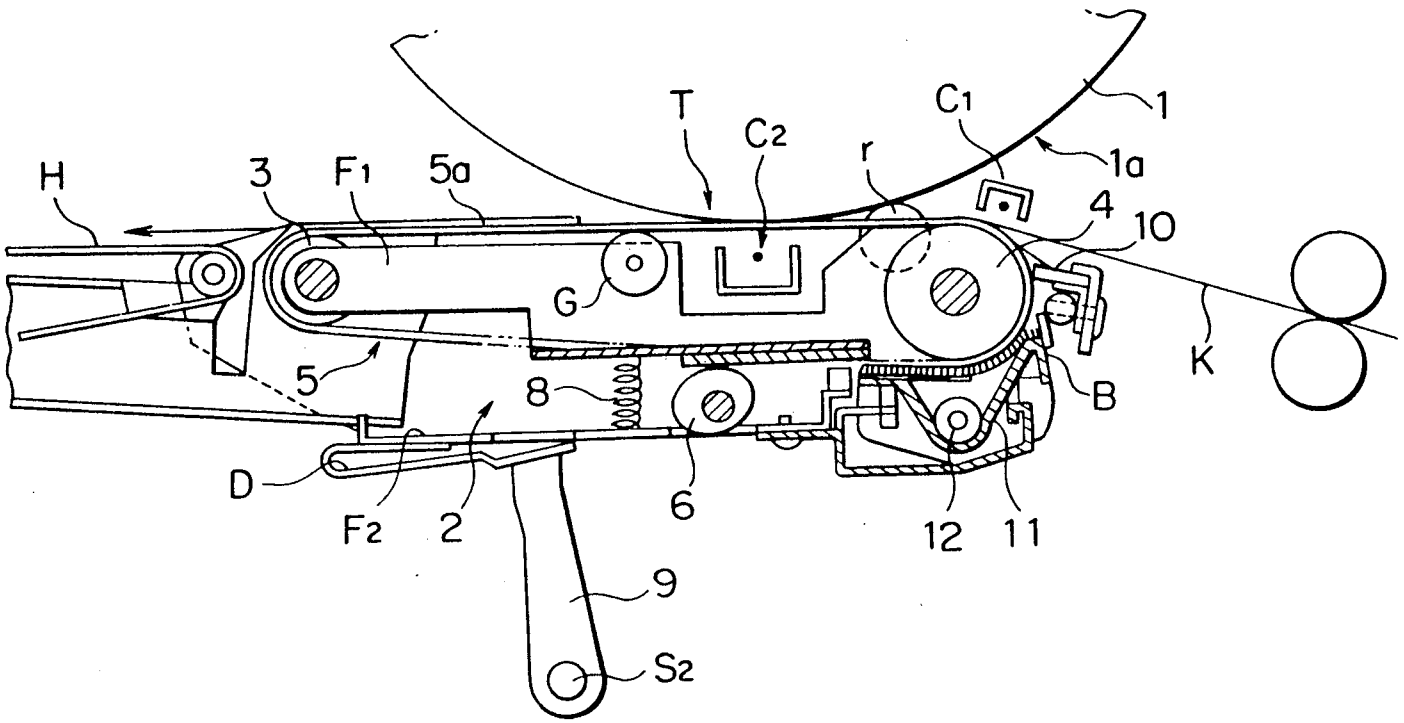
FIG. 1 is a sectional view of the image forming apparatus of the present invention when transfer is conducted.

The following are the explanations of an example of the image forming apparatus of the present invention, wherein the image forming apparatus is a color image copier.

In the drawings, the numeral 1 is a photoreceptor drum which is provided inside the image forming apparatus body. The image of a document (not shown in the drawing) placed on a platen glass is transformed into a toner image on the photoreceptor drum 1, the external circumferential surface 1*a* of which is made from a photosensitive material. A toner image is formed on the photoreceptor drum surface 1*a* in such a manner that: the light reflected by the document is irradiated on the external circumferential surface 1*a* so that an electrostatic latent image can be formed; and the latent image is developed by the toner in the development unit 20 so that a toner image can be formed. In the image forming apparatus of the present invention, this operation is repeatedly conducted for each primary color (Y, M, C and Bk) and a toner image in full color can be obtained.

The numeral 2 is a transfer belt unit which is composed of a delivery side roller (a drive roller) 3, an entry roller (an idle roller) 4, an endless transfer belt 5 stretched around the rollers 3 and 4, and upper frame $F_1$ holding the above-described movable members.

The transfer belt 5 electrostatically attracts recording paper K which has been supplied from an automatic paper feed unit or a hand feeding tray. Charger $C_2$ used for transferring the toner image on the above-described photoreceptor drum 1, is provided in a position below transfer part T in which the drum 1 and the transfer belt 5 are contacted.

Recording paper K is conveyed as follows: recording paper K which has been sent from a paper feed unit or a hand feeding tray, is previously exposed to the electric charge of the same polarity as the toner by the action of charger $C_1$ so that the toner can not be attracted by recording paper K; recording paper K is conveyed onto the transfer belt 5; and in transfer portion T, recording paper K is strongly attracted by the transfer belt 5 which is charged by charger $C_2$ to the reverse polarity, so that recording paper K is maintained flat and the toner can be strongly and tightly adhered to recording paper K.

Figure 2:
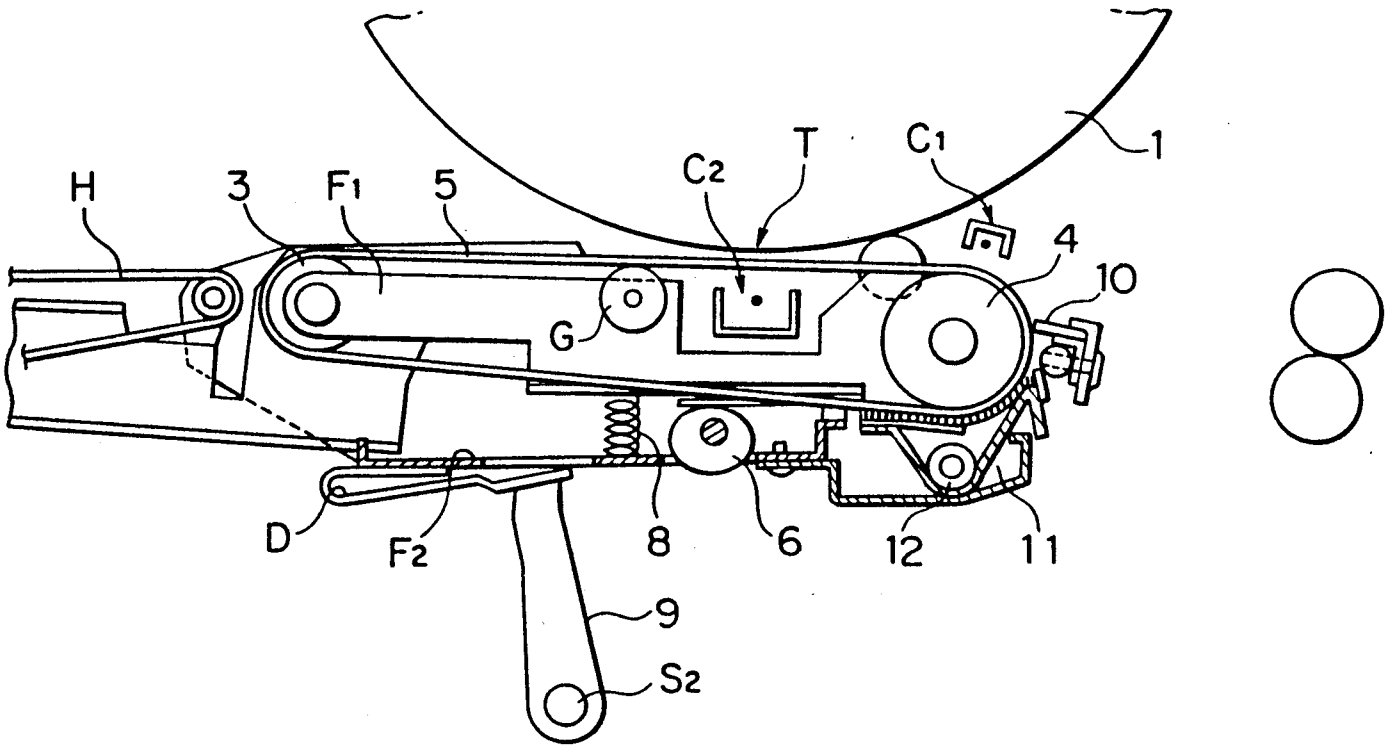
FIG. 2 is a sectional view of the image forming apparatus of the present invention when transfer is not conducted.
Figure 3:
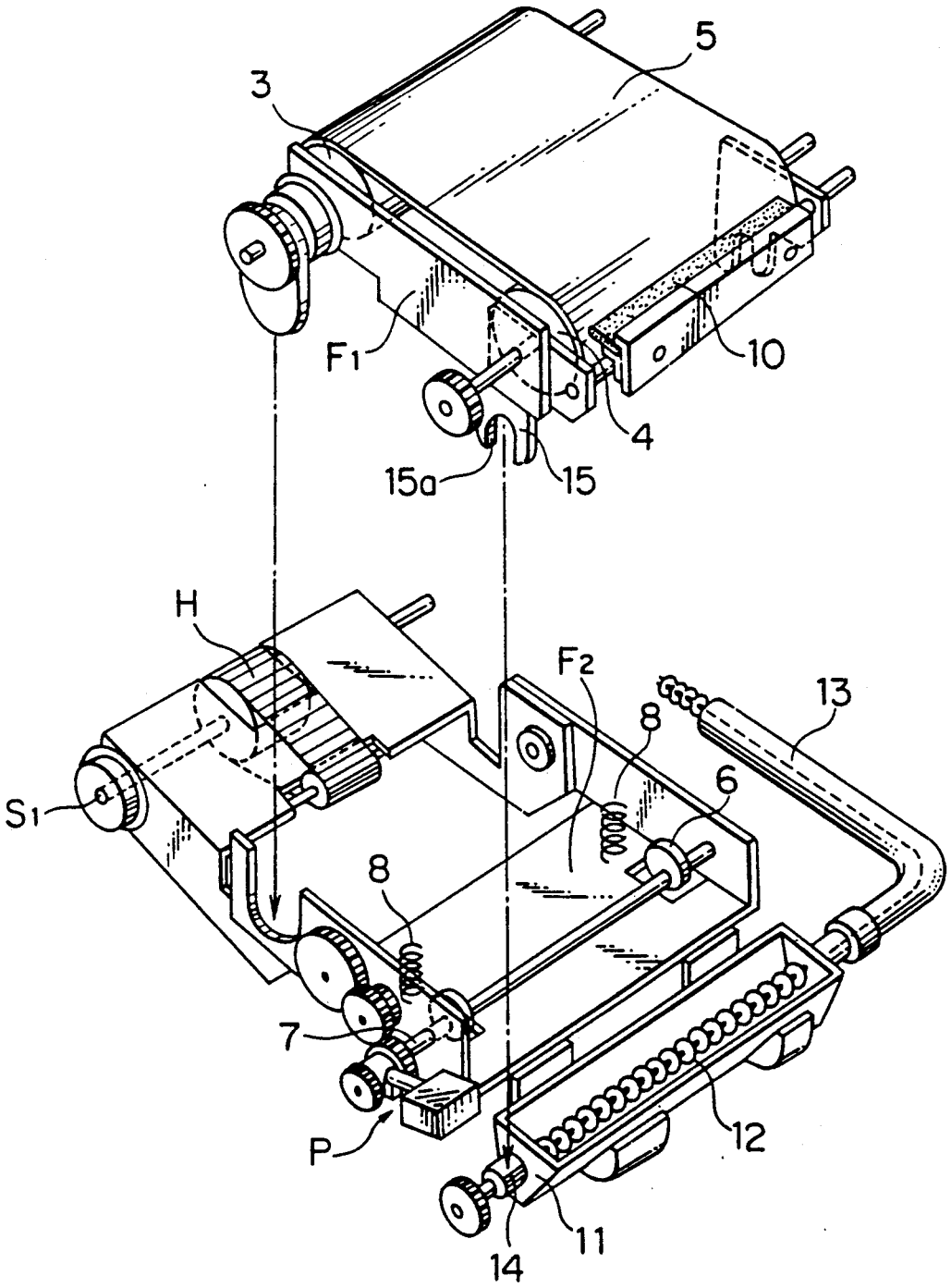
FIG. 3 is a perspective view of a transfer belt unit.
Figure 4:
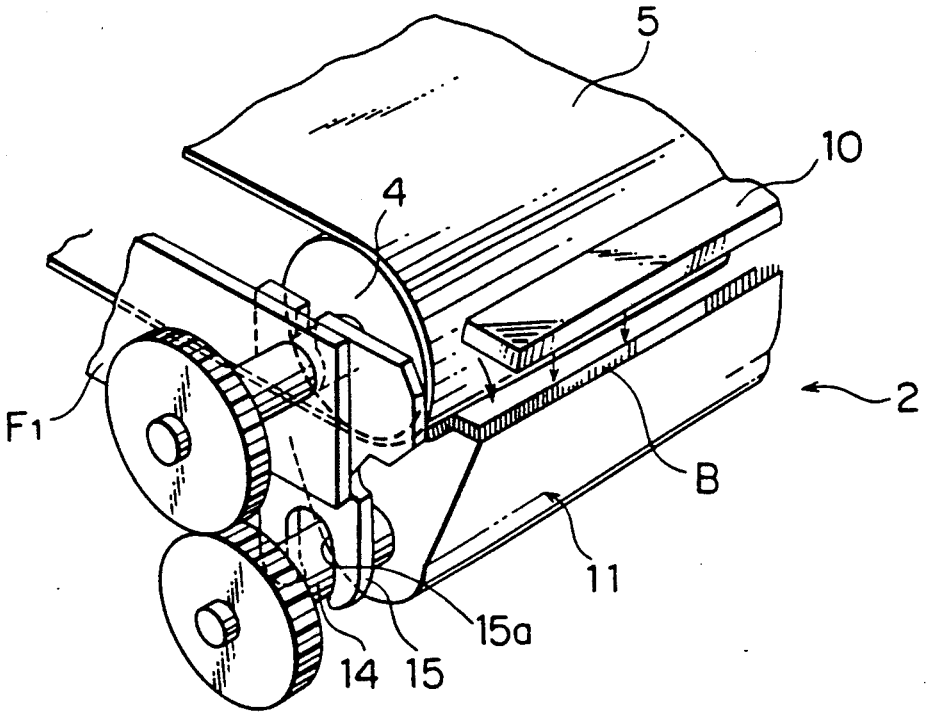
FIG. 4 is a perspective view of a toner recovery unit.
Figure 5:
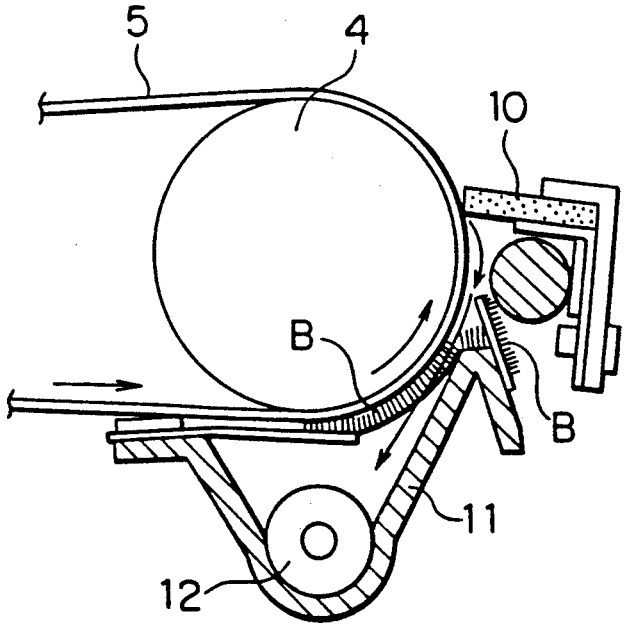
FIG. 5 is a sectional view of the toner recovery unit.

Even when supporting frame $F_2$ is fixed to the apparatus body, the above-described upper frame $F_1$ can be rotated around the delivery side roller 3 so that upper frame $F_1$ can be relatively moved with regard to the photoreceptor drum 1. When upper frame $F_1$ is moved a little in the vertical direction by the cam 6 provided on supporting frame $F_2$, the above-described transfer belt 5 can be contacted with the photoreceptor drum 1 (as illustrated in FIG. 1) when image transfer is performed, and the transfer belt 5 can be separated from the photoreceptor drum 1 (as illustrated in FIG. 2) when image transfer is not performed.

The cam 6 is rotated by the drive shaft 7, wherein the drive shaft 7 is controlled by timing control unit P consisting of a sensor to detect the leading edge of recording paper K and a solenoid (not shown in the drawing), so that the transfer belt 5 can be contacted with and separated from the photoreceptor drum 1 according to the conveyance position of recording paper P.

At a position in upper frame $F_1$ close to the entry side roller 4 is provided the ratchet (the holding means) 15 which holds the handle 14 of the toner recovery box 11.

The above-described supporting frame $F_2$ is placed below the above-described transfer belt unit 2 in order to support it, and provided with the above-described cam 6, the cam drive shaft 7 and the spring means 8 so that supporting frame $F_2$ can be rotated around fulcrum $S_1$ which is provided on the delivery side (which is the left side in FIGS. 1 and 2). Namely, when supporting frame $F_2$ is rotated around fulcrum $S_1$, the above-described transfer unit 2 is contacted with the photoreceptor drum 1 when the apparatus of the present invention is operated (when a series of image forming operation is conducted), and the transfer belt unit 2 is separated from the photoreceptor drum 1 when maintenance work is conducted (when the transfer belt is exchanged or the apparatus is adjusted). However, in order to realize the working action described above, the toner recovery box 11 placed on the entry roller 3 side, must be supported in the form of a cantilever. Accordingly, a relatively heavy load is given to the cam 6. The character r is a bumping roller which is used in order to determine the gap between supporting frame $F_2$ and the photoreceptor drum 1 when supporting frame $F_2$ is set close to the photoreceptor drum 1. The character G is a guide roller which adjust and stabilize the tension of the transfer belt 5 when transfer is performed.

The above-described spring means 8 facilitates the rotation of the above-described transfer belt unit 2, and is provided between the above-described upper frame $F_1$ and the supporting frame $F_2$, wherein the spring means 8 bears almost all the weight of the transfer belt unit 2 so that the load of the above-described cam 6 can be reduced.

Namely, the load which is given to the above-described cam 6 can be expressed as follows: "the spring force of the spring means" is subtracted from "the weight of the belt unit 2". Consequently, a very small load is given to the cam 6, so that the frequency of mechanical breakdown is low and further it is possible to realize a transfer belt drive system which can be moved in quick response.

The numeral 9 is an arm which supports the bottom of supporting frame $F_2$. When the arm 9 is rotated around fulcrum $S_2$, the rotative position of supporting frame $F_2$ can be controlled and the above-described transfer belt unit 2 can be contacted with or separated from the photoreceptor drum 1. The character D is a buffer to reduce the shock given the supporting frame $F_2$ by the arm 9.

The numeral 10 is a blade which is placed at a position close to the above-described entry side roller 4 and comes into contact with the surface of the above-described transfer belt 5 in order to scrape the residual toner on the transfer belt 5. The numeral 11 is a toner recovery box, which is located at a position close to an optional roller that comes into contact with the inside of the transfer belt 5, in this example the toner recovery box 11 is located below the above-described entry side roller 4, and which collects the scraped toner by the action of the blade 10. The numeral 12 is a screw which is provided inside the toner recovery box 11, and which conveys the collected toner to a toner tube 13 located on the side of the toner recovery box 11 so that the collected toner can be discharged into a toner accumulating portion (not illustrated in the drawing) which is connected with the toner tube 13. The character B is a brush to prevent toner scattering. Brush B is made of feathers and seals the gap between the above-described transfer belt 5 and the toner recovery box 11 in order to prevent the collected toner from scattering.

The numeral 14 is a handle which is made of a cylindrical member and provided on both sides of the toner recovery box 11. When the handle 14 is held by the ratchet (the holding means) 15, the transfer belt unit 2 and the toner collecting box 11 can be unified. To be specific, the ratchet 15 is made of a plastic member and provided with a C-shaped portion 15*a* so that the handle 14 can be held and released due to the resilient deformation of the plastic member. The apparatus of the present invention is operated as follows: the handle 14 is held by the ratchet 15; even though the transfer belt unit 2 is vertically moved by the cam 6, the transfer belt unit 2 and the toner recovery box 11 are unified so that the collected toner can be prevented from scattering; and when maintenance work is conducted, the handle 14 is released from the ratchet 15 and the transfer belt unit 2 can be removed from the apparatus body.

In the above-described example, recording paper K conveyed from the paper feed part, is conveyed onto the transfer belt 5 of the transfer belt unit 2, which transfer belt 5 is previously exposed to the electric charge of the same polarity as that of the toner by the action of charger $C_1$. Then a toner image formed on the photoreceptor drum 1 in the development part 20, is transferred onto a recording paper in transfer part T. At this moment, the arm 9 pushes up supporting frame $F_2$ and further the cam 6 pushes up upper frame $F_1$, so that the transfer belt 5 is contacted with the photoreceptor drum 1 with pressure. In transfer part T, the electric charge of which polarity is reverse to that of the toner, is sharply supplied by charger $C_2$, so that recording paper K closely comes into contact with the upper surface 5*a* of the transfer belt 5 and attracts the toner on its surface. Recording paper K is conveyed by the transfer belt 5 while its shape is flat. At this moment, the spring means 8 supports almost all of the weight of the transfer unit 2 and the weight is transmitted to to the arm 9 through supporting frame $F_2$. Accordingly, the load given to the cam 6 is very low. Since the handle 14 of the toner recovery box 11 is held by the ratchet 15, the toner recovery box 11 is never separated from the transfer belt 5. Further, brush B seals the gap between the transfer belt 5 and the toner recovery box 11, so that there is no fear of toner scattering. When maintenance work is conducted, the handle 14 can be easily released from the ratchet 15 and the transfer belt unit can be easily removed.

The position of supporting frame $F_2$ is determined by bumping roller r and its bumping force is appropriately reduced by the action of buffer D. After images have been transferred onto recording paper K, the transfer belt unit 2 is rotated around the delivery side roller 3 and separated from the photoreceptor drum 1. A small amount of toner which has been left on the surface of the transfer belt 5, is scraped off by brush B and the blade 10, collected into the toner recovery box 11 and discharged into the tube 13 by the screw 12. Recording paper K is also conveyed to the delivery side by delivery belt H.

As explained above, the present invention is to provide an image forming apparatus which is provided with a transfer belt unit consisting of a transfer belt stretched between an entry side roller and a delivery side roller and provided with a cam mechanism on a support frame side, which cam mechanism is rotated around the delivery side roller so that the transfer belt can be contacted with a photoreceptor drum with pressure when transfer is performed and the transfer belt can be separated from the photoreceptor drum when transfer is not performed, and which image forming apparatus is characterized in that: a spring means is provided between said belt unit and support frame so that the weight of said transfer belt can be reduced. Consequently, the load given to the cam can be greatly reduced and the apparatus can be prevented from wearing out, so that the occurrence of mechanical breakdown can be prevented.

As a result, the present invention contributes to improvements in maintainability and reliability of an image forming apparatus.

Further, the present invention is to provide an image forming apparatus which is provided with a transfer belt unit consisting of a transfer belt stretched between an entry side roller and a delivery side roller and provided with a cam mechanism on a support frame side, which cam mechanism is rotated around the delivery side roller so that the transfer belt can be contacted with a photoreceptor drum with pressure when transfer is performed and the transfer belt can be separated from the photoreceptor drum when transfer is not performed, and which image forming apparatus which is characterized in that: a toner scrape means to scrape the residual toner on the belt, is provided close to one of the rollers which comes into contact with the inside surface of said transfer belt; a toner recovery box holding means which holds a toner recovery box at an appropriate position on said transfer belt, is provided. Consequently, the transfer belt unit and the toner recovery box can be unified while the apparatus is in operation in order to prevent toner scattering, and the toner recovery box can be easily separated from the transfer belt unit when maintenance work is conducted.

As a result, the present invention contributes to improvements in the stability of operation and the maintainability.

What is claimed is:

1. An apparatus for forming an image, comprising:

means for carrying a toner image on an imaging surface thereof; and a transfer belt assembly having a predetermined weight including:

a plurality of rollers; and a belt rotatable around said plurality of rollers so as to convey a recording sheet thereon, said transfer belt assembly adapted to be pivotable around a pivot axis thereof between a first position on which said belt is brought in contact with said imaging surface and a second position in which said belt is spaced away from said imaging surface, wherein said second position is vertically spaced from said first position;

a cam pivotably contacting a first distinct supporting point of said transfer belt assembly for lifting up said transfer belt assembly to said first position and for lowering said transfer belt assembly to said second position; and a spring disposed independently of said cam and contacting a second distinct supporting point of said transfer belt assembly to support at least a part of said predetermined weight of said transfer belt assembly, thereby reducing the weight contacting said cam member.

2. The apparatus of claim 1, wherein said transfer belt assembly is disposed beneath said carrying means, and further comprising means to activate said cam for lifting said transfer belt assembly when said belt is conveying the recording sheet and lowering said transfer belt assembly when said belt is not conveying the recording sheet.

3. The apparatus of claim 1, wherein said plurality of rollers includes a roller at a sheet feed side and a roller at a sheet delivery side, and wherein said pivot axis of said transfer belt means is disposed along an axis of said roller at said sheet delivery side.

4. The apparatus of claim 1, wherein said transfer belt assembly further includes means for scraping toner deposited on said belt, and means for collecting said scraped toner.

5. The apparatus of claim 4, wherein said scraping means is provided adjacent one of said plurality of rollers.

6. The apparatus of claim 5, wherein said one roller is a roller at a sheet feed side.

* * * * *